US009301545B2

(12) United States Patent
Li et al.

(10) Patent No.: US 9,301,545 B2
(45) Date of Patent: Apr. 5, 2016

(54) CIGARETTE CASE FOR ELECTRONIC CIGARETTES

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Zhiqu Jiao, Shenzhen (CN); Biao Xiang, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 14/515,498

(22) Filed: Oct. 15, 2014

(65) Prior Publication Data

US 2015/0101944 A1 Apr. 16, 2015

(30) Foreign Application Priority Data

Oct. 15, 2013 (CN) ..... 2013 1 0480477

(51) Int. Cl.

| | |
|---|---|
| ***B65D 85/10*** | (2006.01) |
| ***A24F 15/12*** | (2006.01) |
| ***A24F 15/18*** | (2006.01) |
| *A24F 47/00* | (2006.01) |

(52) U.S. Cl.

CPC ..... *A24F 15/12* (2013.01); *A24F 15/18* (2013.01); *A24F 47/002* (2013.01); *A24F 47/008* (2013.01)

(58) Field of Classification Search

CPC ..... B65D 85/12; A24F 15/12; A24F 47/002

USPC ..... 206/242, 249, 251, 252, 263, 265, 261, 206/262, 266, 267; 220/524, 821, 822, 826; 131/240.1, 241, 242, 242.5

See application file for complete search history.

(56) References Cited

U.S. PATENT DOCUMENTS

| | | | | |
|---|---|---|---|---|
| 2,303,859 | A * | 12/1942 | Panzer | 221/79 |
| 4,077,538 | A * | 3/1978 | Waterbury | 220/268 |
| 6,474,342 | B1 * | 11/2002 | Rennecamp | 131/241 |
| 6,814,081 | B2 * | 11/2004 | Hasler | 131/235.1 |
| 7,717,259 | B2 * | 5/2010 | Hatton | 206/236 |
| 8,584,842 | B2 * | 11/2013 | Fakhouri et al. | 206/236 |
| 9,032,966 | B2 * | 5/2015 | Geraths | 131/180 |
| 2001/0013350 | A1 * | 8/2001 | Cho | 131/235.1 |
| 2002/0088469 | A1 * | 7/2002 | Rennecamp | 131/330 |
| 2005/0247582 | A1 * | 11/2005 | Rennecamp | 206/236 |

* cited by examiner

*Primary Examiner* — Jacob K Ackun
*Assistant Examiner* — Jenine Pagan
(74) *Attorney, Agent, or Firm* — Cheng-Ju Chiang

(57) ABSTRACT

The present disclosure relates to an exemplary cigarette case for receiving electronic cigarettes. The cigarette case includes a housing and a cover assembly pivotally coupled to the housing. The housing defines a chamber for receiving the electronic cigarettes, and includes an end surface. The cover assembly is rotatable around an axis perpendicular to the end surface between a first position where the chamber is covered by the cover assembly and a second position where the chamber is exposed.

14 Claims, 10 Drawing Sheets

CIGARETTE CASE FOR ELECTRONIC CIGARETTES

TECHNICAL FIELD

The present disclosure relates to a cigarette case, and particularly to cigarette cases for electronic cigarette.

BACKGROUND ART

Typical cigarette cases for electronic cigarettes are similar to that for ordinary cigarettes in structure and shape, except that the cigarette cases for electronic cigarettes are made of plastic. However, the structure of these cigarette cases for electronic cigarettes is old and unattractive.

What is needed, therefore, is a cigarette case, which can overcome the above shortcomings.

SUMMARY

The present disclosure relates to an exemplary cigarette case for receiving electronic cigarettes. The cigarette case includes a housing and a cover assembly pivotally coupled to the housing. The housing defines a chamber for receiving the electronic cigarettes, and includes an end surface. The cover assembly is rotatable around an axis perpendicular to the end surface between a first position where the chamber is covered by the cover assembly and a second position where the chamber is exposed.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below and with references to the drawings.

Figure 1:
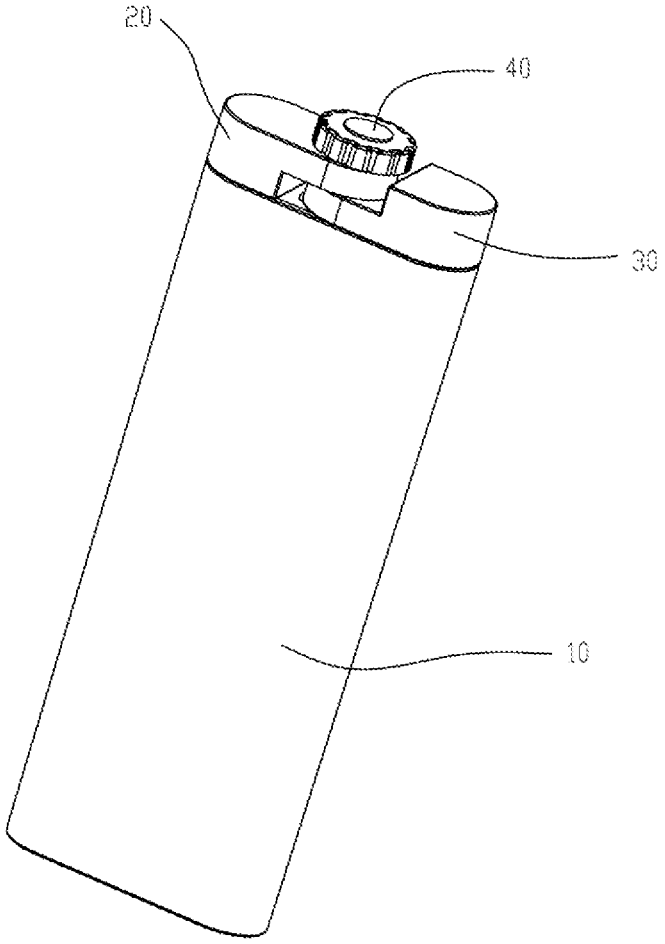
FIG. 1 is a perspective view of a cigarette case according to a first embodiment.

Referring to FIG. 1, a cigarette case for electronic cigarettes according to a first embodiment is shown. The cigarette case includes a housing and a cover assembly. The housing defines a chamber 103 for receiving the electronic cigarettes. The cover assembly is arranged at one end of the housing and hinged to the housing. The cover assembly includes an end surface. The cover assembly is capable of rotating around an axis perpendicular to the end surface to expose or shield the chamber 103. In the present embodiment, the housing and the cover assembly are made of plastic.

Figure 2:
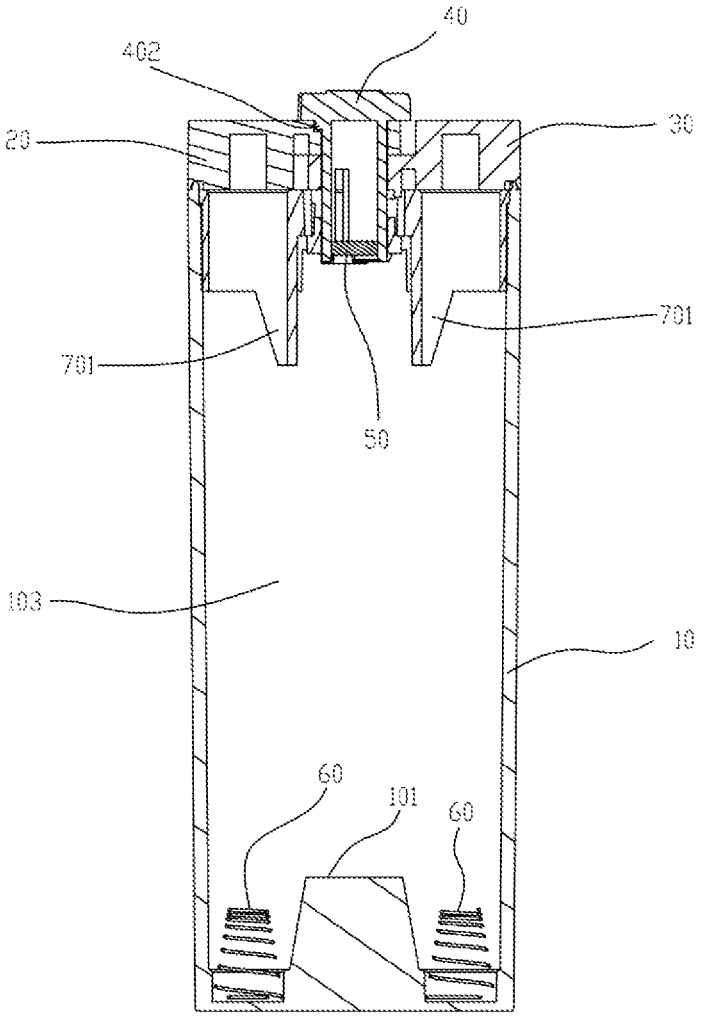
FIG. 2 is a cross-sectional view of the cigarette case of FIG. 1.
Figure 4:
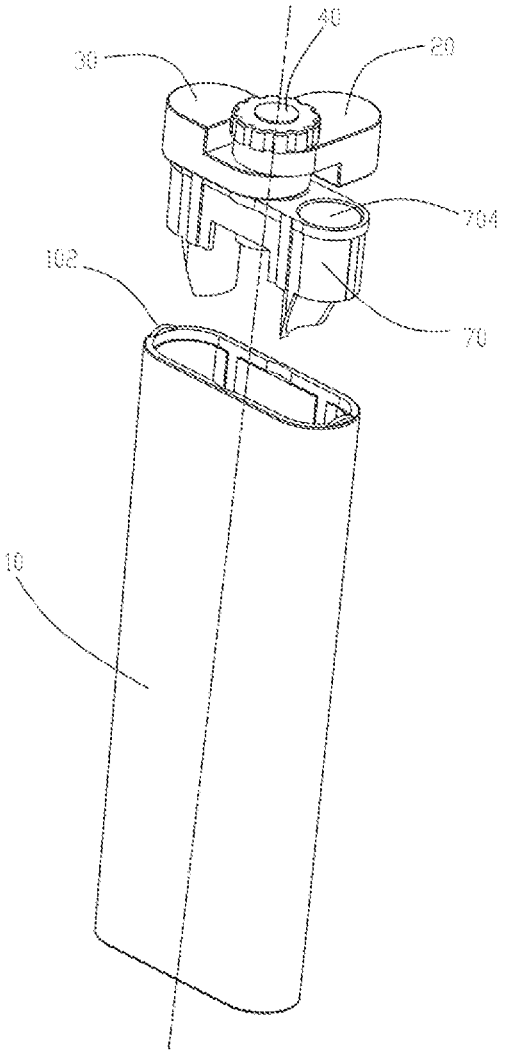
FIG. 4 is a perspective view of the cigarette case when the holder is separated from the main body.

Referring to FIG. 2 and FIG. 4, the housing includes a main body 10 and a holder 70 arranged at one end of the main body 10. In the present embodiment, the holder 70 is inserted into the main body 10. The holder 70 includes a shaft 40, and two through holes 704 communicating with the chamber 103. The cover assembly is pivotally coupled to the holder 70 via the shaft 40. The cover assembly is rotatable around the shaft 40 to cover or expose the through hole 704. In the present embodiment, the cover assembly includes a first cover 20 and a second cover 30. The first cover 20 and the second cover 30 are both pivotally coupled to the holder 70. The first cover 20 and the second cover 30 are rotated to cover or expose the through hole 704.

Figure 5:
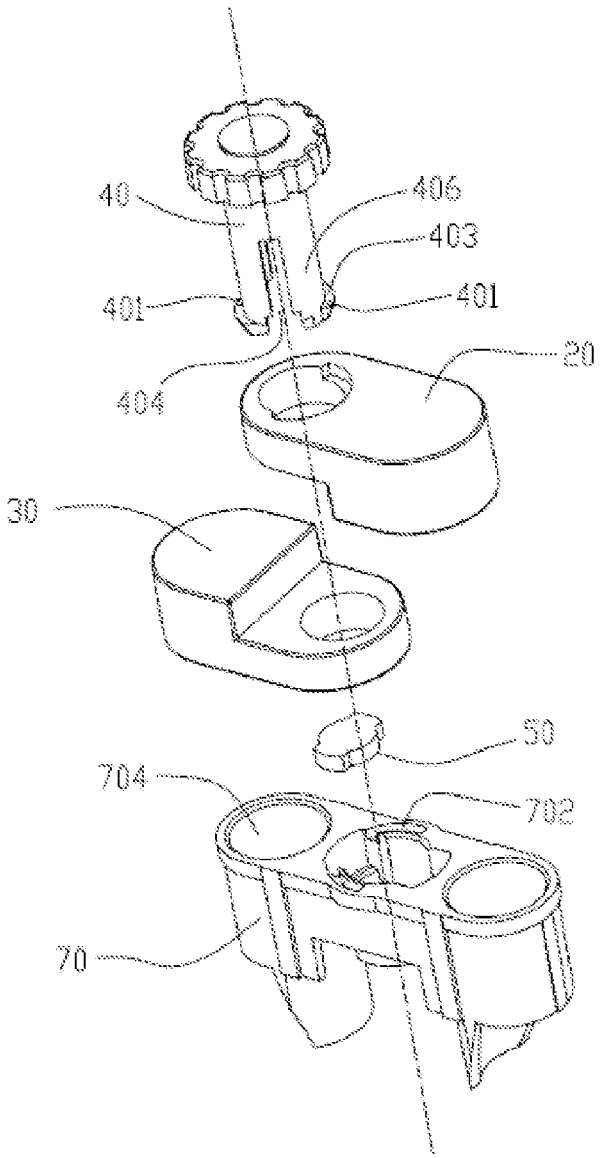
FIG. 5 is an exploded perspective view of a holder, a cover assembly and a shaft of the cigarette case of FIG. 1.
Figure 8:
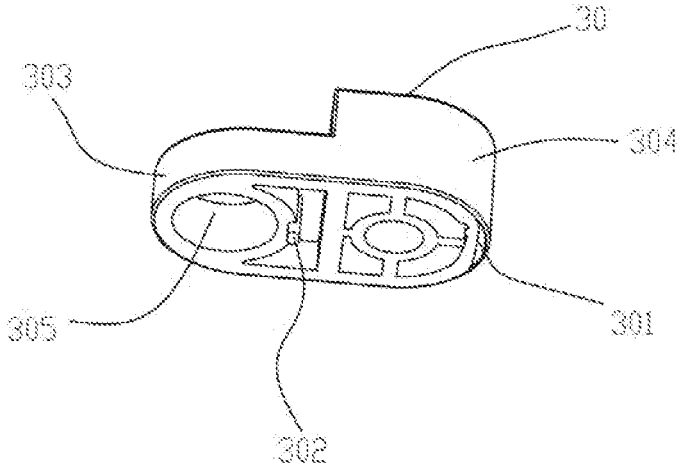
FIG. 8 is a perspective view of a second cover of FIG. 1.
Figure 10:
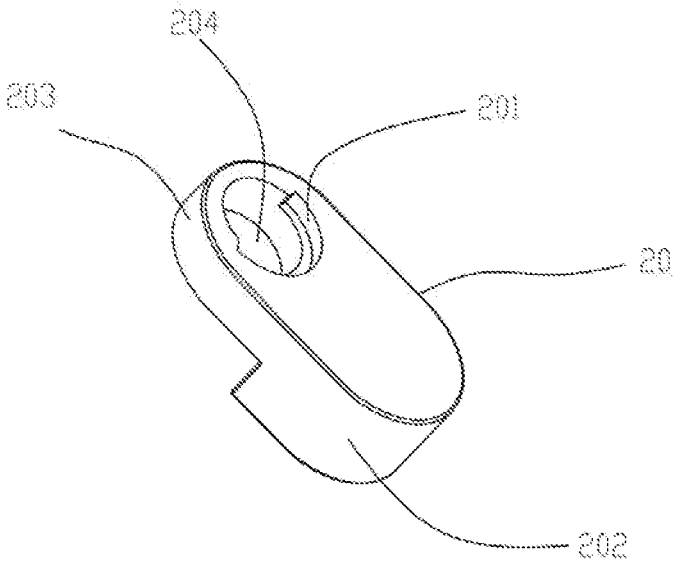
FIG. 10 is a perspective view of a first cover of FIG. 1.

Referring to FIG. 5, FIG. 8 and FIG. 10, the first cover 20 includes a first cover body part 202 and a first connection part 203, and the second cover 30 includes a second cover body part 304 and a second connection part 303. The first cover body part 202 and the second cover body part 304 are positioned above the through holes 704, and configured (i.e., structured and arranged) for shielding a respective through hole 704. The first connection part 203 and the second connection part 303 are pivotally coupled to the holder 70. In the present embodiment, the first cover body part 202 and the second cover body part 304 have a same thickness. A total thickness of the first connection part 203 and the second connection part 303 equals to that of the first cover body part 202. After the first cover 20 and the second cover 30 are coupled to the holder 70 via the shaft 40, a bottom surface of the first cover 20 and a bottom surface of the second cover 30 are positioned on the same plane. The bottom surface of the first cover 20 is a surface which is in contact with the holder 70. The first connection part 203 defines a first connection hole 204, and the second connection part 303 defines a second connection hole 305. After the first cover 20 and the second cover 30 are coupled to the holder 70, the first connection hole 204 aligns with the second connection hole 305, and the shaft 40 engages in the first connection hole 204 and the second connection hole 305. A top portion of the shaft 40 exposes from the first connection hole 204, and is configured for adjusting tightness of the first cover 20 and the second cover 30 (described in detail later). The first connection part 203 and the second connection part 303 each include a cylindrical side surface.

Referring to FIG. 2 and FIG. 5, the holder further includes a guiding wall 701 extending from the through hole 704 into the chamber 103. The guiding wall 701 is configured for guiding an electronic cigarette when the electronic cigarette is placed into or taken out.

Referring to FIG. 4, FIG. 5 and FIG. 8, an end of the shaft 40 defines a notch 404, which divides the shaft 40 into two arms 406. Each of the arms 406 includes a latching portion 403 at one end. The latching portion 403 is engaged with the holder 70 by snap fit to axially position the shaft 40. The notch 404 makes the two arms 406 deformable, thus facilitating the assembly of the shaft 40 and the holder 70. It is to be understood that the shaft 40 and the holder 70 may be coupled by other ways, e.g., using pins.

Figure 6:
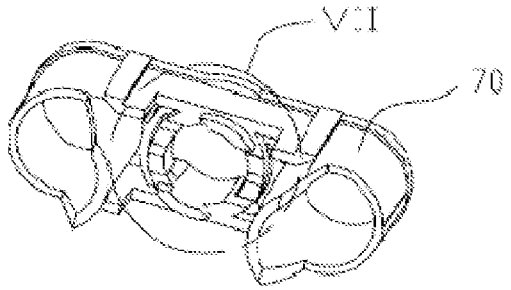
FIG. 6 is a perspective view of the holder of FIG. 1.
Figure 7:
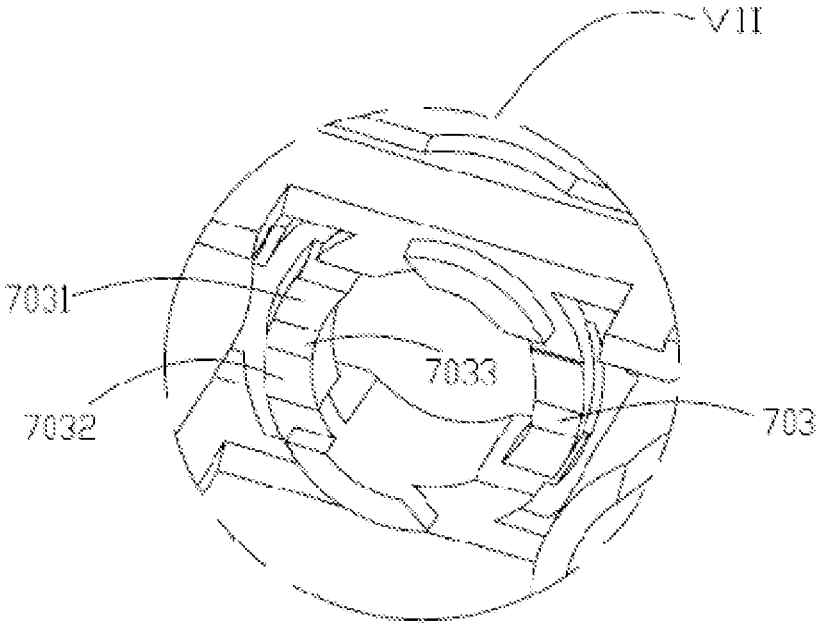
FIG. 7 is a partially enlarged view of area VII of the holder of FIG. 6.

Referring to FIG. 6 and FIG. 7, two elastic blocks 703 are sandwiched between the holder 70 and the latching portion 403. One end of each elastic block 703 is fixedly connected with the holder 70, and the other end of each elastic block 703 forms a free end. The shaft 40 and the holder 70 are elastically coupled, so that the engagement between the shaft 40 and the holder 70 is reliable because certain error in accuracy of components (e.g., the shaft 40) may be overcome.

Referring to FIG. 5, FIG. 8, the holder 70 defines a guiding slot 702, and the second cover 30 includes a restriction rod 302 matching with the guiding slot 702. The restriction rod 302 is engaged in the guiding slot 702. A rotated angle of the second cover 30 may be controlled by controlling the path of the restriction rod 302 in the guiding slot 702.

Figure 9:
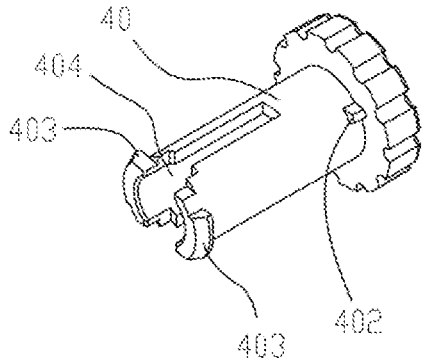
FIG. 9 is a perspective view of a shaft of FIG. 1.

Referring to FIG. 9 and FIG. 10, the shaft 40 includes a limit block 402, and the first cover 20 includes a guiding rail 201 matching with the limit block 402. The limit block 402 is engaged with the guiding rail 201. A rotated angle of the first cover 20 is controlled by controlling the path of the limit block 402 in the guiding rail 201.

In the present embodiment, a rotated angle of each of the first cover 20 and the second cover 30 is in a range from 0 degrees to 180 degrees. When the first cover 20 and the second cover 30 are rotated 90 degrees respectively, it is easy to take the electronic cigarette out of the cigarette case.

Referring to FIG. 7, in the present embodiment, each elastic block 703 includes a first surface 7031, second surface 7032, and a transition part 7033 connected between the first surface 7031 and the second surface 7032. The second surface 7032 is higher than the first surface 7031, so that the tightness of the first cover 20 and the second cover 30 can be adjusted by selectively engaging the second surface 7032 or the first surface 7031 through rotating the top portion of the shaft 40. The second surface 7032 is adjacent to a connecting portion between the elastic block 703 and the holder 70.

Referring to FIG. 5, the latching portion 403 includes a protrusion 401. Correspondingly, the elastic block 703 may include a recess portion in the first surface 7031 and a recess portion in the second surface 7032. The recess portions are configured for engaging with the protrusion 401, so that the latching portion 403 and the elastic block 703 are coupled firmly.

Figure 3:
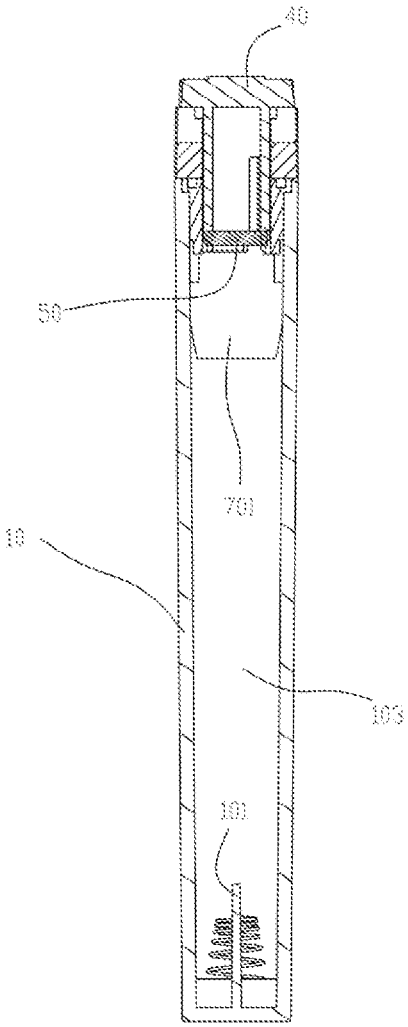
FIG. 3 is another cross-sectional view of the cigarette case of FIG. 1.

Referring to FIG. 3 and FIG. 5, the shaft 40 is hollow, and the cigarette case further includes a plate 50 engaged in the notch 404 of the shaft 40. The plate 40 prevents the two arms 406 of the shaft 40 from deforming, thus preventing the shaft 40 from separating from the holder 70 after assembled.

Referring to FIGS. 2-4, the cigarette case further includes a guiding plate 101 and an elastic element 60 at a bottom of the chamber 103. The guiding plate 101 is configured for guiding the electronic cigarette when the electronic cigarette is placed in the chamber 103. The elastic element 60 is configured for ejecting the electronic cigarette out of the chamber via the through hole 704.

Figure 11:
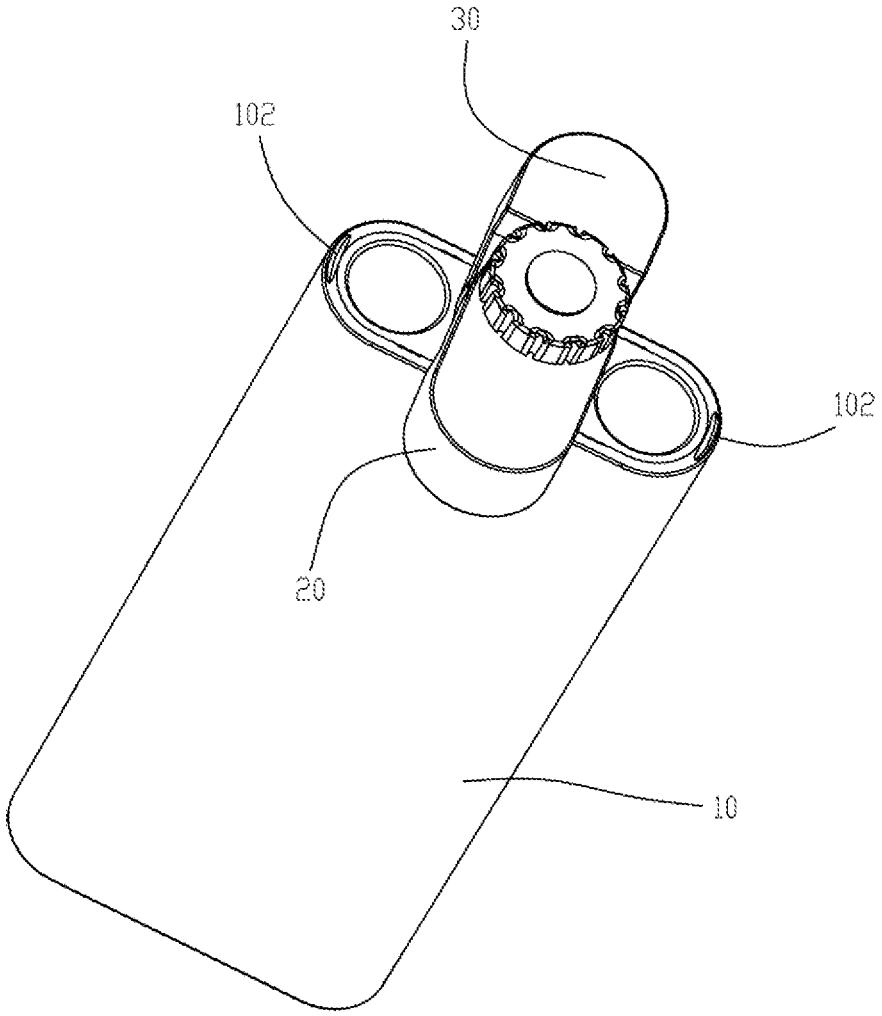
FIG. 11 is a perspective view of the cigarette case of FIG. 1, when the cigarette case is opened.

Referring to FIGS. 8 and 11, the main body 10 further includes two positioning blocks 102. Correspondingly, the first cover 20 and the second cover 30 each define recesses 301 matching with the positioning blocks 102. Accordingly, when in a closed state, the first and the second covers 20, 30 are not easily rotated. It should be noted that the positioning blocks 102 may be formed on the first and the second covers 20, 30, and the recesses 301 may be defined in the main body 10.

It is to be understood that a contact surface between the elastic block 703 and the latching portion 403 may be an inclined surface.

Figure 12:
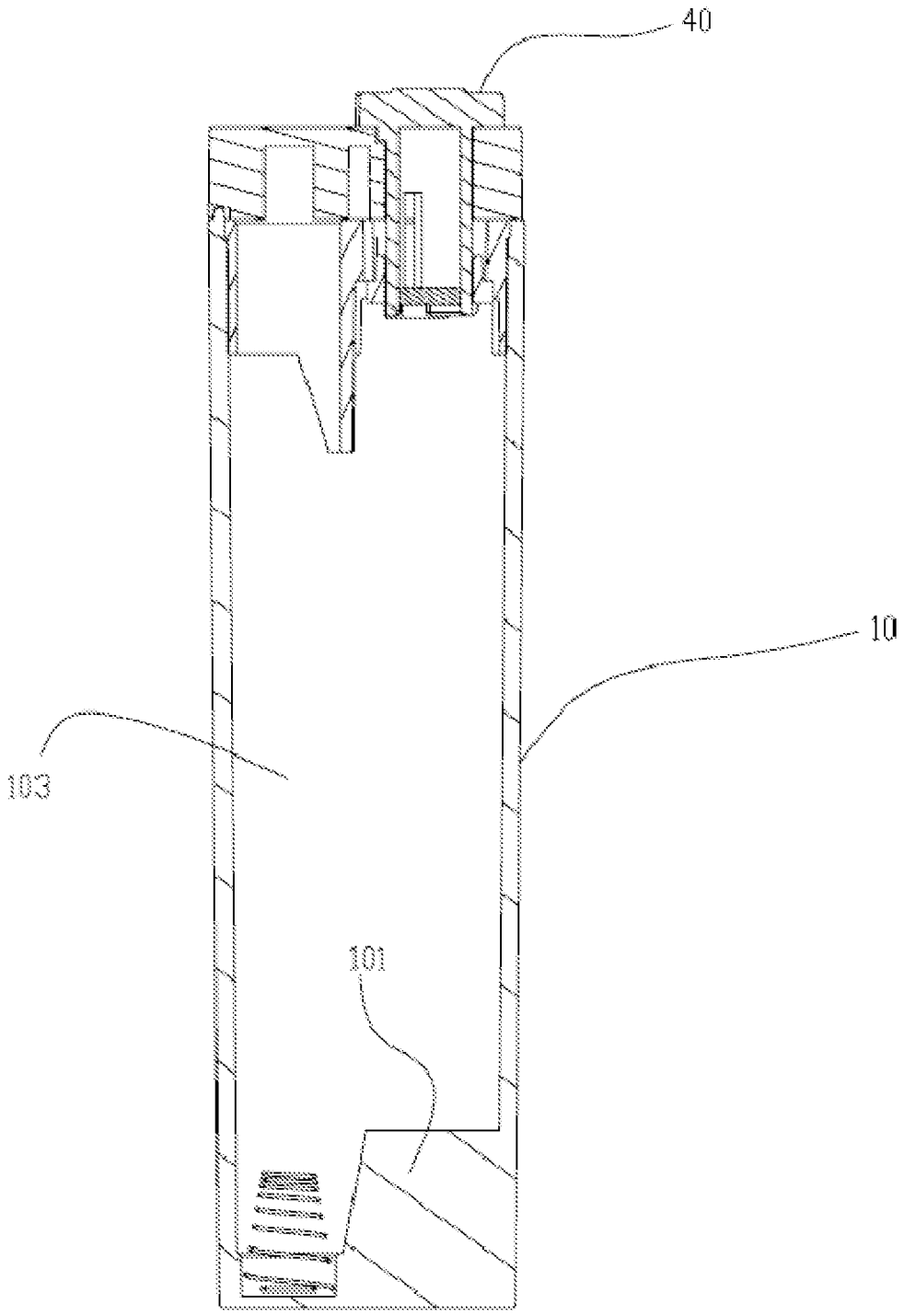
FIG. 12 is a cross-sectional view of a cigarette case according to a second embodiment.

Referring to FIG. 12, a cigarette case, according to a second embodiment, includes a main body 10, a cover arranged at a top end of the main body 10. The main body 10 defines a chamber 103. The cigarette case of the present embodiment is similar to that of the first embodiment, except that this cigarette case includes only one cover, and the holder 70 defines only one through hole 704 communicating the chamber 103.

Figure 13:
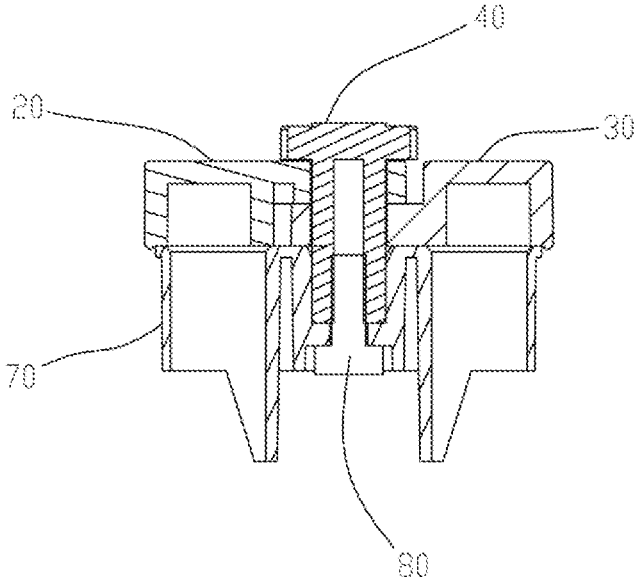
FIG. 13 is a cross-sectional view of a cigarette case according to a third embodiment.

Referring to FIG. 13, a cigarette case according to a third embodiment is shown. In the drawing, only part of the cigarette case is shown. This cigarette case is similar to that of the first embodiment, except that the shaft 40 and the holder 70 are threadedly coupled. In detail, the shaft 40 includes external screws formed on an outer surface, and the holder 70 includes internal screws.

Quite usefully, the cigarette case further includes a screw 80 engaged with the shaft 40. The shaft 40 has a hollow structure, and includes internal threads for coupling with the screw 80.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A cigarette case for receiving electronic cigarettes, comprising:

a housing, the housing defining a chamber for receiving the electronic cigarettes, the housing comprising an end surface;

a cover assembly pivotally coupled to the housing, the cover assembly being rotatable around an axis perpendicular to the end surface between a first position where the chamber is covered by the cover assembly and a second position where the chamber is exposed; and a shaft, wherein the housing comprises a main body and a holder arranged at one end of the main body, the holder defines at least one through hole communicating with the chamber, the cover assembly is rotatably coupled to the holder via the shaft, and the shaft is oriented along the axis;

wherein the cover assembly comprises a first cover and a second cover, the at least one through hole comprises two through holes, the first cover and the second cover are rotatably coupled to the holder via the shaft; and wherein the shaft comprises a limit block, the first cover comprises a guiding rail matching with the limit block, the limit block is engaged with the guiding rail.

2. The cigarette case of claim 1, wherein the holder defines a guiding slot, and the second cover comprises a restriction rod matching with the guiding slot, and the restriction rod is engaged in the guiding slot.

3. The cigarette case of claim 1, wherein the holder further comprises a guiding wall extending from the at least one through hole into the chamber.

4. The cigarette case of claim 1, wherein an end of the shaft defines a notch, the notch divides the shaft into two arms, each of the arms comprises a latching portion at one end, and the latching portion is engaged with the holder by snap fit to axially position the shaft.

5. The cigarette case of claim 4, further comprising an elastic block sandwiched between the holder and the latching portion, one end of the elastic block is fixedly connected with the holder, and an opposite end of the elastic block forms a free end.

6. The cigarette case of claim 5, wherein the elastic block comprises a first surface and a second surface higher than the first surface, and the second surface is adjacent to a connecting portion between the elastic block and the holder.

7. The cigarette case of claim 5, wherein the elastic block further comprises a transition part connected between the first surface and the second surface.

8. The cigarette case of claim 4, further comprising a plate engaged in the notch of the shaft.

9. The cigarette case of claim 1, further comprising an elastic element arranged at a bottom of the chamber, the elastic element being configured for ejecting the electronic cigarette out of the chamber when the chamber is exposed.

10. The cigarette case of claim 1, wherein the housing comprises a positioning block, and the cover defines a recess matching with the positioning block.

11. The cigarette case of claim 1, wherein the shaft and the holder are threadedly coupled.

12. The cigarette case of claim 1, wherein the first cover comprises a first cover body part and a first connection part, and the second cover comprises a second cover body part and a second connection part, the first connection part defines a first connection hole, the second connection part defines a second connection hole, when the first cover and the second cover are coupled to the holder, the first connection hole aligns with the second connection hole, and the shaft engages in the first connection hole and the second connection hole.

13. A cigarette case for receiving electronic cigarettes, comprising:

a housing, the housing defining a chamber for receiving the electronic cigarettes, the housing comprising an end surface;

a cover assembly pivotally coupled to the housing, the cover assembly being rotatable around an axis perpendicular to the end surface between a first position where the chamber is covered by the cover assembly and a second position where the chamber is exposed; and a shaft, wherein the housing comprises a main body and a holder arranged at one end of the main body, the holder defines at least one through hole communicating with the chamber, the cover assembly is rotatable coupled to the holder via the shaft, and the shaft is oriented along the axis;

wherein the cover assembly comprises a first cover and a second cover, the at least one through hole comprises two through holes, the first cover and the second cover are rotatably coupled to the holder via the shaft; and wherein the holder defines a guiding slot, and the second cover comprises a restriction rod matching with the guiding slot, and the restriction rod is engaged in the guiding slot.

14. A cigarette case for receiving electronic cigarettes, comprising:

a housing, the housing defining a chamber for receiving the electronic cigarettes, the housing comprising an end surface;

a cover assembly pivotally coupled to the housing, the cover assembly being rotatable around an axis perpendicular to the end surface between a first position where the chamber is covered by the cover assembly and a second position where the chamber is exposed; and a shaft, wherein the housing comprises a main body and a holder arranged at one end of the main body, the holder defines at least one through hole communicating with the chamber, the cover assembly is rotatable coupled to the holder via the shaft, and the shaft is oriented along the axis;

wherein an end of the shaft defines a notch, the notch divides the shaft into two arms, each of the arms comprises a latching portion at one end, and the latching portion is engaged with the holder by snap fit to axially position the shaft.

* * * * *